US008882554B2

(12) United States Patent
McKinney

(10) Patent No.: US 8,882,554 B2
(45) Date of Patent: Nov. 11, 2014

(54) GLOW-IN-THE-DARK STAND UP PADDLEBOARD AND/OR WAKEBOARD

(71) Applicant: Charles McKinney, Abilene, TX (US)

(72) Inventor: Charles McKinney, Abilene, TX (US)

( * ) Notice: Subject to any disclaimer, the term of this patent is extended or adjusted under 35 U.S.C. 154(b) by 92 days.

(21) Appl. No.: 13/646,106

(22) Filed: Oct. 5, 2012

(65) Prior Publication Data

US 2013/0165003 A1 Jun. 27, 2013

Related U.S. Application Data

(63) Continuation-in-part of application No. 13/333,126, filed on Dec. 21, 2011, now Pat. No. 8,662,949.

(51) Int. Cl.
*B63B 35/79* (2006.01)

(52) U.S. Cl.
CPC ..... *B63B 35/7926* (2013.01); *B63B 35/7936* (2013.01)
USPC ..... 441/74; 362/477

(58) Field of Classification Search
USPC ..... 440/101; 441/65, 74, 79; 362/108, 477
See application file for complete search history.

(56) References Cited

U.S. PATENT DOCUMENTS

| | | | | |
|---|---|---|---|---|
| 3,893,938 | A * | 7/1975 | Rauhut | 252/700 |
| 4,578,042 | A | 3/1986 | Evert | |
| 5,421,287 | A | 6/1995 | Yonover | |
| 6,257,942 | B1 | 7/2001 | Groover | |
| 6,270,386 | B1 | 8/2001 | Visocekas | |
| 6,461,210 | B2 * | 10/2002 | Lorenzo | 441/79 |
| 7,018,258 | B2 | 3/2006 | McLarty | |
| 7,189,128 | B2 | 3/2007 | Halliday | |
| 7,740,512 | B1 * | 6/2010 | Patterson | 441/74 |
| 8,186,021 | B2 * | 5/2012 | Gonzalez | 24/3.1 |
| 2008/0311805 | A1 | 12/2008 | Spears et al. | |
| 2010/0102065 | A1 | 4/2010 | Phelan | |
| 2010/0136862 | A1 | 6/2010 | Vick | |

* cited by examiner

*Primary Examiner* — Lars A Olson
(74) *Attorney, Agent, or Firm* — Buckingham, Doolittle & Burroughs, LLC

(57) ABSTRACT

A glow in the dark paddleboard and/or wakeboard is disclosed that is visible in low-light conditions. The paddleboard and/or wakeboard comprises a top surface visible in low-light conditions. Preferably, the paddleboard and/or wakeboard comprises at least one glow in the dark element that is photoluminescent following sufficient exposure to a recharging source. The paddleboard and/or wakeboard are used in surface water sports and allow a user to traverse the surface of a body of water. However, when the user is in or near the water at night, or in other low-light scenarios, the glow in the dark element radiates visible light enabling a companion, or a rescuer to better visualize the user, thereby increasing the likelihood of a successful retrieval or rescue if required, and also prevents accidents as passing boats and other watercraft are more likely to see the individual and not run them over.

20 Claims, 5 Drawing Sheets

GLOW-IN-THE-DARK STAND UP PADDLEBOARD AND/OR WAKEBOARD

CROSS-REFERENCE

This application is a continuation-in-part of patent application Ser. No. 13/333,126 filed Dec. 21, 2011.

FIELD OF THE INVENTION

This invention pertains generally to a glow in the dark paddleboard and/or wakeboard and/or surfboard that is visible in low-light conditions, and more particularly to a durable conventional paddleboard and/or wakeboard and/or surfboard having a phosphorescent portion that illuminates under low-light conditions.

BACKGROUND

The paddleboard and/or wakeboard and/or surfboard are used in surface water sports and allow a user to traverse the surface of a body of water. Paddleboards allow users to propel through the water via a paddle or oar or a user's hands. A user utilizes the paddleboard by standing, sitting, kneeling, or laying on the paddleboard. In contrast, a user utilizes the wakeboard by standing or kneeling on the wakeboard, and propelling themselves through the water by being towed behind a motorboat, or other means. And, a user utilizes the surfboard by standing on the surfboard and surfing or propelling through the waves. Furthermore, the paddleboard and the wakeboard and the surfboard have sufficient buoyancy for retaining the paddleboard and/or wakeboard and/or surfboard and the user at the surface of a body of water.

While traditional paddleboards and/or wakeboards and/or surfboards may keep an individual somewhat buoyant in the water, the paddleboards and/or wakeboards and/or surfboards may not provide an obvious indication of the users' locations in the event of an emergency or even just to alert a passing boater of the individual's presence under low-light conditions. This is of particular concern during situations when an individual becomes lost at night or in dark, choppy waters. The dark colors of conventional paddleboards and/or wakeboards and/or surfboards may prevent rescuers, or other companions from easily spotting individuals, further delaying the rescue or identification process.

Therefore, a paddleboard and/or wakeboard and/or surfboard that increases the visibility of a user would be advantageous. The proposed invention allows a rescuer, or other companion to more easily visualize an individual surfing, floating or paddling in water in the dark, or under any other low-light conditions. This increased visibility increases the likelihood of a successful retrieval, identification, and/or rescue of the user.

SUMMARY

Accordingly, the present invention overcomes the limitations of the prior art by providing a unique and useful glow in the dark paddleboard or wakeboard or surfboard that increases the visibility of a user in the water especially under low-light conditions.

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a paddleboard or wakeboard or surfboard that is visible in low-light conditions. In one embodiment, the paddleboard or wakeboard or surfboard comprises a top surface visible in low-light conditions. Preferably, the paddleboard or wakeboard or surfboard comprises at least one glow in the dark element that is photoluminescent following sufficient exposure to a recharging source.

The paddleboard and/or wakeboard and/or surfboard are used in surface water sports and allow a user to traverse the surface of a body of water. However, when the user is in or near the water at night, or in other low-light scenarios, the glow in the dark element emits visible light enabling a companion, or a rescuer to better visualize the user. Further, the glow in the dark element is rechargeable following exposure to a recharging source. The paddleboard and/or wakeboard and/or surfboard can be used to increase the user's safety in a wide variety of water related activities, namely, paddleboarding, boating, wakeboarding, surfing, and the like.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1B:
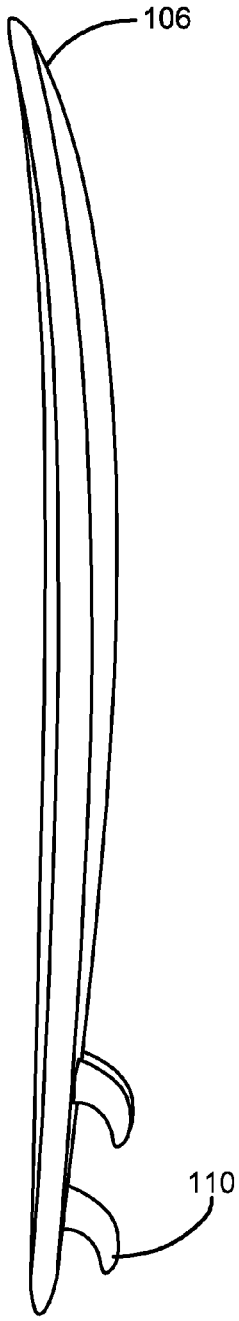
FIGS. 1B and 1A illustrate a perspective view of a glow in the dark paddleboard in accordance with the disclosed architecture.

Safety of individuals on or near the water is of paramount importance to people who enjoy or engage in recreational and professional water sports and activities. Accordingly, the disclosed device is designed for individuals who desire a paddleboard, wakeboard, surfboard, or other board that has increased visibility under low-light conditions. The device allows companions and rescue personal to better visualize individuals in or near the water, thereby increasing the likelihood of a successful retrieval or rescue if required, and also prevents accidents as passing boats and other watercraft are more likely to see the individual and not run them over.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

Figure 1A:
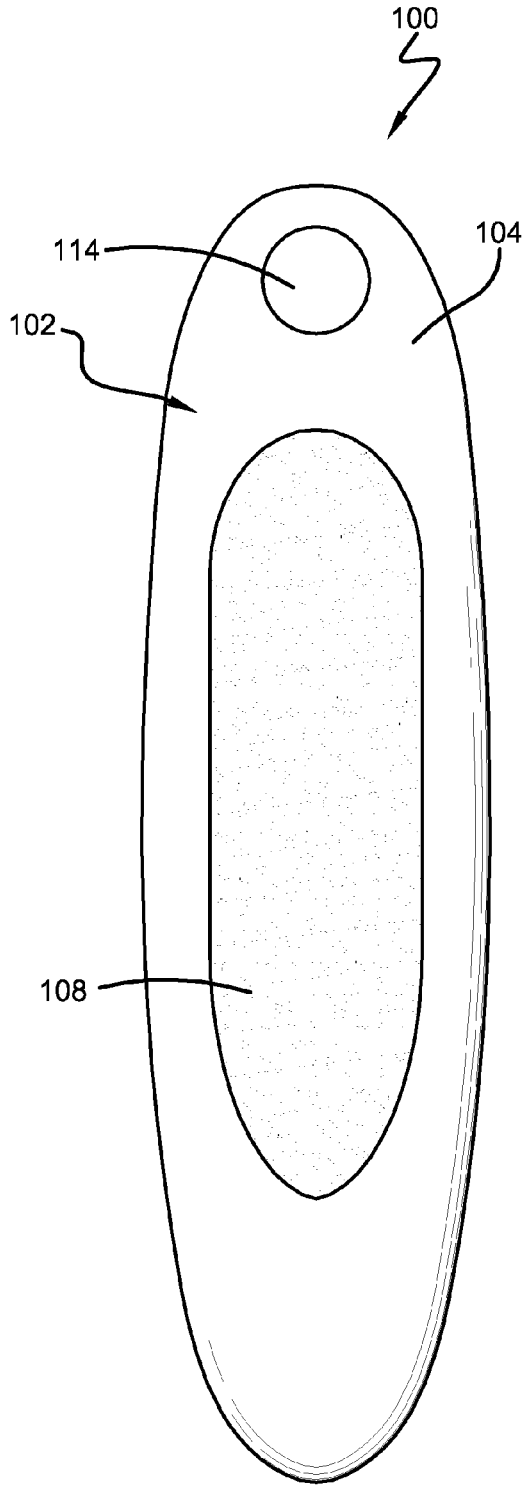

The invention relates generally to a photoluminescent paddleboard, wakeboard, surfboard, or other board for use in the water, for improved visibility of a user in or near the water under less than ideal visibility conditions such as at night. Referring initially to the drawings, FIGS. 1B and 1A illustrate paddleboards 100 for use in water, such as stock boards which have a fixed rudder and are approximately twelve feet long, and unlimited boards which have a moveable rudder and may be of any length. Paddleboarding can also be done on various pieces of equipment, including surfboards, or any other suitable piece of equipment for use in the water as is known in the art.

The paddleboard 100 comprises a body portion 102, and a rudder 110. The body portion 102 further comprises a top surface 104 and a bottom surface 106, wherein the top surface 104 comprises a substantially flat portion 108 for receiving a user (not shown). For example, a user can utilize the paddleboard 100 by standing, sitting, kneeling, or laying on the paddleboard 100, and propelling themselves through the water by use of a paddle (not shown) or their hands. Furthermore, the body portion 102 has sufficient buoyancy for retaining the paddleboard 100 and the user at the surface of a body of water.

Additionally, the top surface 104 and/or bottom surface 106 of the body portion 102, and/or the rudder 110 glows or is visible under low-light conditions. Specifically, the top surface 104, the bottom surface 106, and/or the rudder 110 can comprise at least one glow in the dark element 114. For example, at least 5-100% of the surface area of the top surface 104, the bottom surface 106, and/or the rudder 110 is covered by the glow in the dark element 114. Further, the paddle or oar can also be covered (completely or partially) in glow in the dark material, and any other part of the body portion 102 can also be covered (completely or partially) in glow in the dark material.

The paddleboard 100 would generally be constructed of fiberglass, epoxy, carbon fiber, and the like, though any other suitable material may be used to manufacture the paddleboard 100 as is known in the art without affecting the overall concept of the invention. Further, the paddleboard 100 may also be inflatable, and made of poly vinyl chloride (PVC) and drop-stitch fabric for portable storage and easy transportation. Typically, the paddleboard 100 is approximately between 8 to 21 feet long, though the board can be any suitable length as is known in the art without affecting the overall concept of the invention.

When utilized, a user swims out to a desired location in a body of the water with the paddleboard 100 and pulls himself or herself up onto the paddleboard 100. The user then sits, kneels, lays, or stands on the flat portion 108 of the paddleboard 100. Then, using a paddle or his or her hands, a user propels themselves through the water on the paddleboard 100.

Furthermore, as the top surface 104 glows or has increased visibility under low-light conditions, either the material of the top surface 104 and/or at least one glow in the dark element 114 having glow in the dark properties attached to the top surface 104 are present in the invention. Glow in the dark properties allow for increased visibility of the paddleboard 100 once sufficiently charged by a light or other radiation source. For example, the at least one glow in the dark element 114 may be charged when exposed to a light source, for example, sunlight, ultra violet light, LED lights, incandescent lights, fluorescent lights, and the like. Once charged, the at least one glow in the dark element 114 will photoluminesce, or in other words, emit visible light.

Preferably, the paddleboard 100 will employ a plurality of the at least one glow in the dark element 114. The at least one glow in the dark element 114 may comprise a plurality of phosphorescent panels of any shape or design. The plurality of phosphorescent panels may be affixed or attached to the top surface 104 by sewing, stitching, radio frequency welding, glue, adhesives, heat, or by any other method known to one skilled in the art. Additionally, the plurality of phosphorescent panels may be attached to the top surface 104 in a variety of positions and orientations, such as to the front, back, and sides for example. Thus, at least 5-100% of the surface area of the top surface 104 is covered by the glow in the dark element 114.

Further, the at least one glow in the dark element 114 may be silk screen sprayed on the top surface 104 or woven directly into the top surface 104. It may be advantageous to make use of a variety of different materials to produce a plurality of different colors to increase visibility of the paddleboard 100 under a variety of weather conditions. For example, the at least one glow in the dark element 114 may contain different colors to aid in recognizing a user's paddleboard 100.

Furthermore, any external portion or accessory of the paddleboard 100 may have photoluminescent properties. For example, the paddleboard 100 may have the at least one glow in the dark element 114 and further comprise glow in the dark decals, patches, bands, letters, numbers, pictures, straps, strap positioning devices, attachment points, and the like. Similarly, the material of the paddleboard 100 and/or the top surface 104 may comprise a photoluminescent material.

The at least one glow in the dark element 114 of the present invention preferably comprises a photoluminescent compound. This allows the user to be more visible at night or under low-light conditions, as photoluminescent compounds emit visible light following sufficient exposure to a light or other comparable radiation source. Typically, the photoluminescent compound will comprise a phosphorescent material to produce the photoluminescence. For example, a phosphor such as copper or silver activated zinc sulfide may be incorporated into a plastic or other materials that make up the at least one glow in the dark element 114. Another preferred phosphor is europium activated strontium aluminate which is useful because it produces a more persistent and brighter visible light emission. However, these phosphors are not meant as a limitation as there are a wide variety of other phosphors and/or activators known to one skilled in the art that may be used as well.

The photoluminescence typically lasts for a period of time that depends on the length of exposure to the light source, the chemical composition of the phosphor and activator, and the type of radiation used for charging. After the phosphorescence abates, the user simply re-exposes the at least one glow in the dark element 114 to the light source. For example, the paddleboard 100 may recharge when left out in the sun. Products made with phosphorescent materials typically maintain their glow in the dark properties for several years as long as they are sufficiently recharged. Also, it is not uncommon for these materials to continue to emit light for up to ten hours or more with each charge.

Additionally, the invention is not limited to phosphor based photoluminescence as fluorescent materials may be used to produce photoluminescence for the paddleboard 100. Therefore, chemiluminescent materials which produce visible light through chemical reactions rather that from exposure to a light source may be used as the at least one glow in the dark element 114 as well. For example, commercially available glow in the dark light sticks, which are activated by removing or cracking a barrier between a plurality of reactants, may be used in the at least one glow in the dark element 114 instead of or in conjunction with a phosphor based photoluminescent material to give off light. It may be advantageous to make use of a variety of different materials to produce a plurality of different colors and/or to have a plurality of different glow time periods. Similarly, the paddleboard 100 may comprise reflective elements (not shown) in conjunction with the photoluminescent and/or chemiluminescent materials to increase visibility of the paddleboard 100 under a variety of weather conditions.

Next, the at least one glow in the dark element 114 may be manufactured into a variety of desired shapes or elements. For example, the plurality of phosphorescent panels may comprise a phosphor powder or pigment mixed with a polymer to produce a flexible panel that may be attached to the top surface 104. These processes are not meant as a limitation as a phosphorescent material may be combined with the at least one glow in the dark element 114 by painting, dying, lining, coating, extruding, embedding, casting, dipping, or by any other method of manufacture known to one of skill in the art.

Figure 2:
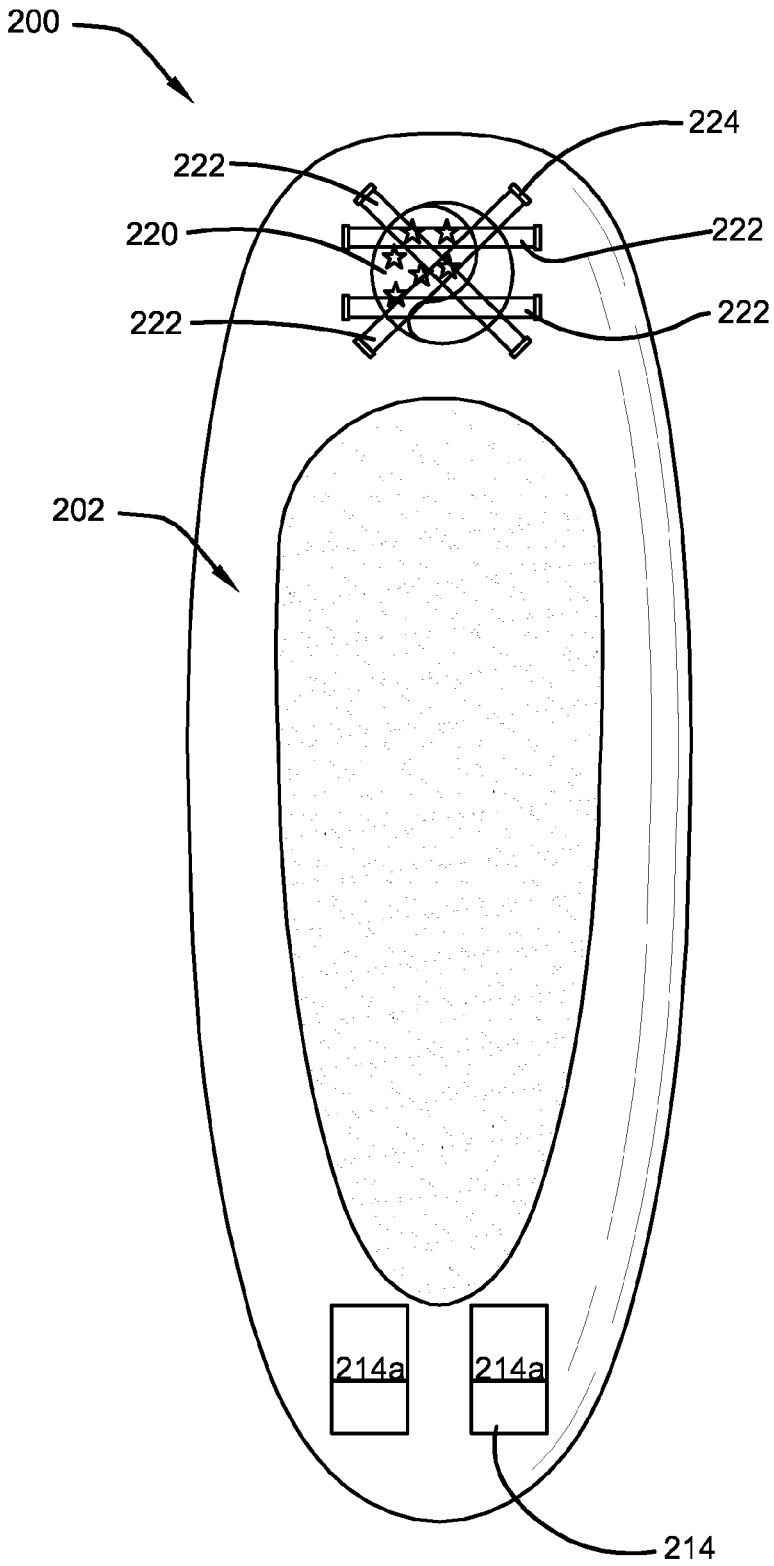
FIG. 2 illustrates a perspective view of a glow in the dark paddleboard in accordance with the disclosed architecture.

In another embodiment as shown in FIG. 2, a paddleboard 200 comprises a top surface 202. At least one glow in the dark element 214, a phosphorescent panel 214(*a*) for example, is attached to the top surface 202. A plurality of securing bands 222 are used to hold a decorative element 220 in place on the top surface 202 of the paddleboard 200. The plurality of securing bands 222 typically comprise a transparent or photoluminescent material and are attached to the top surface 202, as discussed supra. Each of the plurality of securing bands 222 may further comprise an adjusting element 224 for selectively loosening and tightening the plurality of securing bands 222. While the embodiment in FIG. 2 illustrates four of the plurality of securing bands 222, two substantially horizontal and two substantially diagonal, any number may be employed in any orientation without deviating from the scope of the invention. Additionally, any other method of securing the decorative element 220 to the top surface 202, such as with webbing, cords, mesh, and the like may be used.

The decorative element 220 may comprise any design or shape that the user desires that may be held in place by the plurality of securing bands 222. Also, the decorative element 220 may comprise a fluorescent material, a photoluminescent material, or both. To attach the decorative element 220, the user simply loosens the plurality of securing bands 222 with the adjusting element 224, slides the decorative element 220 in place between the plurality of securing bands 222 and the top surface 202, and then tightens the plurality of securing bands 222 with the adjusting element 224. Additionally, the plurality of securing bands 222 may be photoluminescent, transparent, translucent or may have an opening (not shown) for a transparent or translucent portion (not shown) for accepting a tube or panel of chemiluminescent material such as a glow stick.

Figure 3:
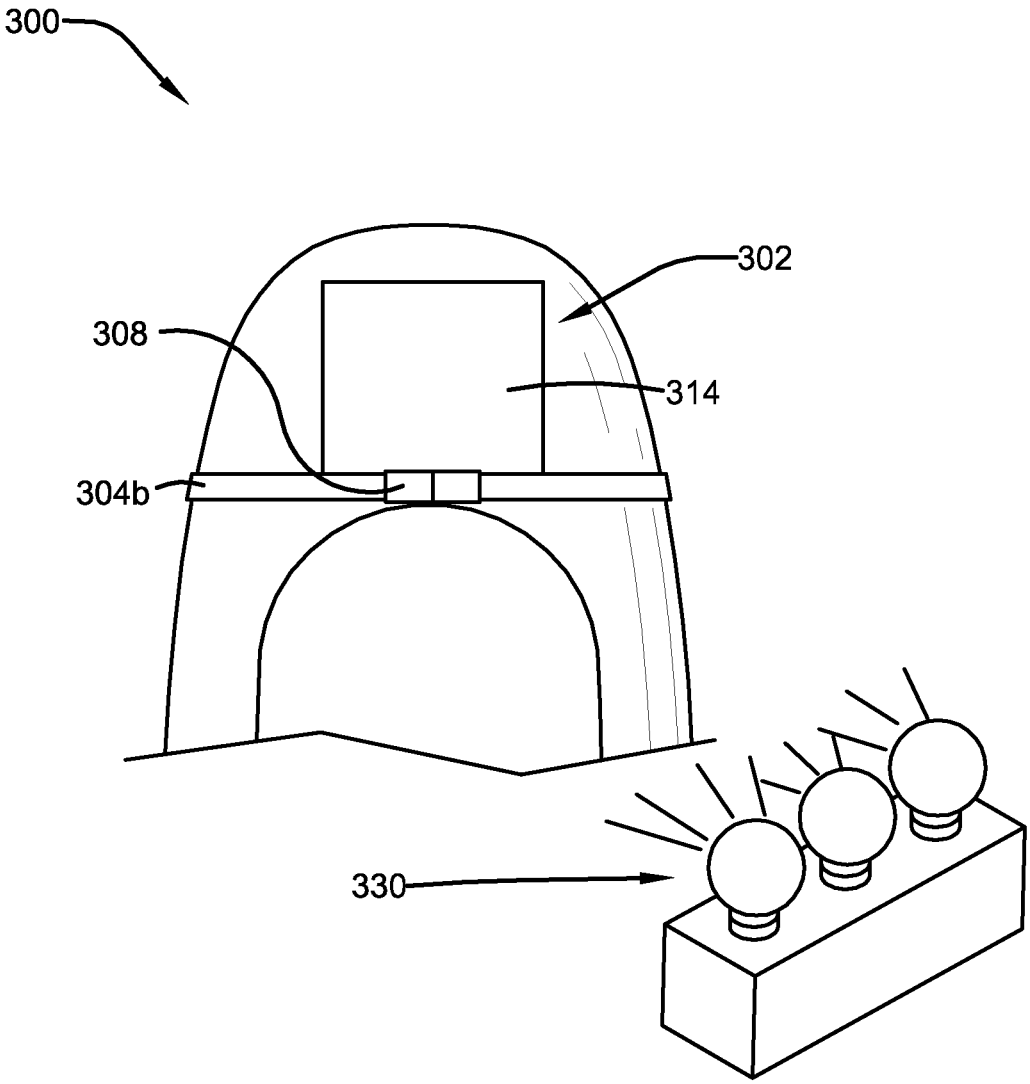
FIG. 3 illustrates a perspective view of a glow in the dark paddleboard in accordance with the disclosed architecture.

FIG. 3 illustrates an embodiment of a paddleboard 300 suitable for storage without a naturally occurring recharging source such as sunlight. Often, paddleboards are stored out of sight and are only removed from storage when needed. Therefore, while still rechargeable by direct sunlight, the paddleboard 300 may also comprise a recharging source 330. The recharging source 330 may provide an artificial or man made light or radiation source so that the paddleboard 300 remains charged and ready for use even when stored away from sunlight or other radiation sources. The recharging source 330 may comprise an ultraviolet light source, a black light, a light-emitting diode, a visible light source, a battery powered flashlight, and the like. Similarly, the recharging source 330 may comprise elements that emit radiation such as tritium and promethium, for example.

The recharging source 330 may or may not attach to the paddleboard 300 as desired. Optionally, the recharging source 330 may simply be clipped on or otherwise affixed anywhere to a top surface 302 of the paddleboard 300. For example, the paddleboard 300 may comprise a strap 304(*b*) with a buckle mechanism 308. The recharging source 330 may then clip on or otherwise attach to the belt or strap 304(*b*). The recharging source 330 is used to recharge an at least one glow in the dark element 314, such as a fluorescent panel or other portion of the paddleboard 300. Alternatively, the recharging source 330 may simply remain where the paddleboard 300 is stored, for example in a cabinet or locker.

Figure 4:
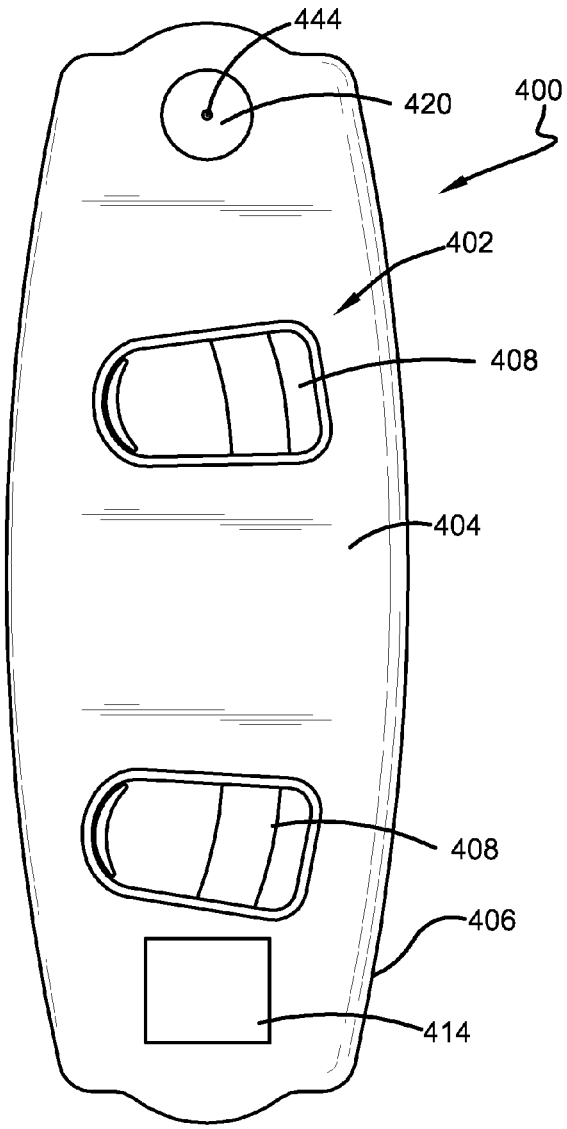
FIG. 4 illustrates a perspective view of a glow in the dark wakeboard with an attachable decorative element in accordance with the disclosed architecture.

FIG. 4 illustrates wakeboards 400 for use in water. Typically, wakeboarding is a sport normally done in lakes, though intercoastal waterways are also becoming popular. Wakeboards 400 are buoyant with a core usually made up of foam, a honeycombed material mixed with resin and coated with fiberglass, or any other suitable material as is known in the art. Typically, metal screws are inserted into the wakeboard 400 to attach bindings and fins.

The configuration and positioning of the fins and bindings varies according to user preference and can be adjusted for a variety of reasons. For example, a wakeboarder will change the type of fins he or she uses for different types of tricks and stunts. For instance, shallow fins (which do not protrude into the water very far) are better for surface tricks, such as flat spins. Furthermore, many newer wakeboard models contain small molded fins on the board which allows the user to use smaller centralized fins and also to create less drag.

Wakeboard hardware is often set up to allow a user to ride with either foot forward. Such setups are usually symmetrical in layout. However, new users normally set up his or her wakeboards to be comfortable to ride with their "natural" foot forward, which does not allow for switching feet without modifications.

The wakeboard 400 comprises a body portion 402, at least one binding 412, and at least one fin 410. The body portion 402 further comprises a top surface 404 and a bottom surface 406, wherein the top surface 404 comprises a substantially flat portion 408 for receiving a user (not shown). For example, a user can utilize the wakeboard 400 by standing or kneeling on the wakeboard 400, and propelling themselves through the water by being towed behind a motorboat (not shown), or other means as is known in the art, such as a closed-course cable system, winches, personal water craft, all-terrain vehicles, etc. Furthermore, the body portion 402 has sufficient buoyancy for retaining the wakeboard 400 and the user at the surface of a body of water.

Additionally, the top surface 404 of the body portion 402 is visible under low-light conditions. Specifically, the top surface 404 can comprise at least one glow in the dark element 414. For example, at least 5-100% of the surface area of the top surface 404 is covered by the glow in the dark element 414. Further, other parts of the wakeboard 400, besides the top surface 404, can also be covered (completely or partially) in glow in the dark material, such as the bottom surface 406, etc.

The wakeboard 400 would generally be constructed of fiberglass, styrofoam, carbon fiber, and the like, though any other suitable material may be used to manufacture the wakeboard 400 as is known in the art without affecting the overall concept of the invention. Typically, the wakeboard 400 is approximately between 120 to 150 centimeters long, though the board can be any suitable length as is known in the art without affecting the overall concept of the invention.

When utilized, a user secures the wakeboard 400 to a tow line (not shown) on a motorboat or other towing means as is known in the art. The user then enters the water and secures himself or herself to the wakeboard 400 by inserting a foot into a binding of the wakeboard 400, and then holds onto the tow line. The motorboat then increase speed and tows the user behind the motorboat, typically at a speed of approximately 17-24 miles per hour. The motorboat creates a wake, and the user rides the wakeboard 400 over the wake while performing stunts and tricks.

Furthermore, as the top surface 404 has increased visibility under low-light conditions, either the material of the top surface 404 and/or at least one glow in the dark element 414 having glow in the dark properties attached to the top surface 404 are present in the invention. Glow in the dark properties allow for increased visibility of the wakeboard 400 once sufficiently charged by a light or other radiation source. For example, the at least one glow in the dark element 414 may be charged when exposed to a light source, for example, sunlight, ultra violet light, LED lights, incandescent lights, fluorescent lights, and the like. Once charged, the at least one glow in the dark element 414 will photoluminesce, or in other words, emit visible light.

Preferably, the wakeboard 400 will employ a plurality of the at least one glow in the dark element 414. The at least one glow in the dark element 414 may comprise a plurality of phosphorescent panels of any shape or design. The plurality of phosphorescent panels may be affixed or attached to the top surface 404 by sewing, stitching, radio frequency welding, glue, adhesives, heat, or by any other method known to one skilled in the art. Additionally, the plurality of phosphorescent panels may be attached to the top surface 404 in a variety of positions and orientations, such as to the front, back, and sides for example. Thus, at least 5-100% of the surface area of the top surface 404 is covered by the glow in the dark element 414.

Further, the at least one glow in the dark element 414 may be silk screen sprayed on the top surface 404 or woven directly into the top surface 404. It may be advantageous to make use of a variety of different materials to produce a plurality of different colors to increase visibility of the wakeboard 400 under a variety of weather conditions. For example, the at least one glow in the dark element 414 may contain different colors to aid in recognizing a user's wakeboard 400.

Furthermore, any external portion or accessory of the wakeboard 400 may have photoluminescent properties. For example, the wakeboard 400 may have the at least one glow in the dark element 414 and further comprise glow in the dark decals, patches, bands, letters, numbers, pictures, straps, strap positioning devices, attachment points, and the like. Similarly, the material of the wakeboard 400 and/or the top surface 404 may comprise a photoluminescent material.

The at least one glow in the dark element 414 of the present invention preferably comprises a photoluminescent compound. This allows the user to be more visible at night or under low-light conditions, as photoluminescent compounds emit visible light following sufficient exposure to a light or other comparable radiation source. Typically, the photoluminescent compound will comprise a phosphorescent material to produce the photoluminescence. For example, a phosphor such as copper or silver activated zinc sulfide may be incorporated into a plastic or other materials that make up the at least one glow in the dark element 414. Another preferred phosphor is europium activated strontium aluminate which is useful because it produces a more persistent and brighter visible light emission. However, these phosphors are not meant as a limitation as there are a wide variety of other phosphors and/or activators known to one skilled in the art that may be used as well.

The photoluminescence typically lasts for a period of time that depends on the length of exposure to the light source, the chemical composition of the phosphor and activator, and the type of radiation used for charging. After the phosphorescence abates, the user simply re-exposes the at least one glow in the dark element 414 to the light source. For example, the wakeboard 400 may recharge when left out in the sun. Products made with phosphorescent materials typically maintain their glow in the dark properties for several years as long as they are sufficiently recharged. Also, it is not uncommon for these materials to continue to emit light for up to ten hours or more with each charge.

Additionally, the invention is not limited to phosphor based photoluminescence as fluorescent materials may be used to produce photoluminescence for the wakeboard 400. Therefore, chemiluminescent materials which produce visible light through chemical reactions rather that from exposure to a light source may be used as the at least one glow in the dark element 414 as well. For example, commercially available glow in the dark light sticks, which are activated by removing or cracking a barrier between a plurality of reactants, may be used in the at least one glow in the dark element 414 instead of or in conjunction with a phosphor based photoluminescent material to give off light. It may be advantageous to make use of a variety of different materials to produce a plurality of different colors and/or to have a plurality of different glow time periods. Similarly, the wakeboard 400 may comprise reflective elements (not shown) in conjunction with the photoluminescent and/or chemiluminescent materials to increase visibility of the wakeboard 400 under a variety of weather conditions.

Next, the at least one glow in the dark element 414 may be manufactured into a variety of desired shapes or elements. For example, the plurality of phosphorescent panels may comprise a phosphor powder or pigment mixed with a polymer to produce a flexible panel that may be attached to the top surface 404. These processes are not meant as a limitation as a phosphorescent material may be combined with the at least one glow in the dark element 414 by painting, dying, lining, coating, extruding, embedding, casting, dipping, or by any other method of manufacture known to one of skill in the art.

Figure 4A:
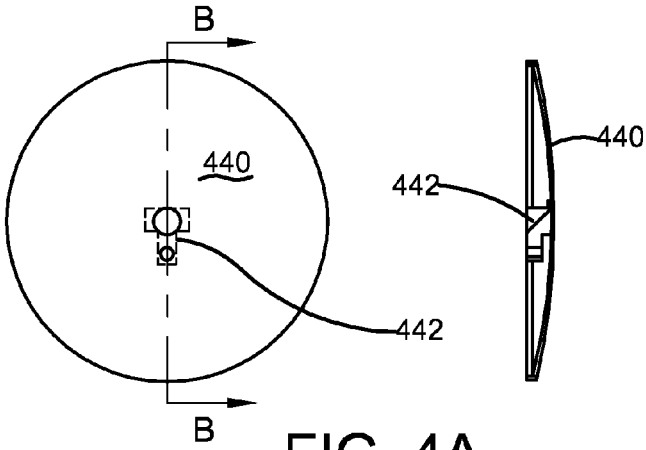
FIG. 4A illustrates a side view of the attachable decorative element of the glow in the dark wakeboard in accordance with the disclosed architecture.

Specifically, FIG. 4 illustrates an embodiment of a wakeboard 400 with a customizable design. The top surface of the wakeboard 400 comprises an attachment surface 440 for attaching a decorative element 420. As illustrated in FIG. 4A, the attachment surface 440 is typically a convex disk of material, plastic for example, that is glued on or otherwise attached, as discussed supra, to the wakeboard 400. In addition, the attachment surface 440 may optionally be affixed to the wakeboard 400 with a mechanical fastener 444, such as a screw or rivet. Furthermore, the attachment surface further comprises a T-slot 442 for accepting a T-peg 446 (as shown in FIG. 5).

Figure 5A:
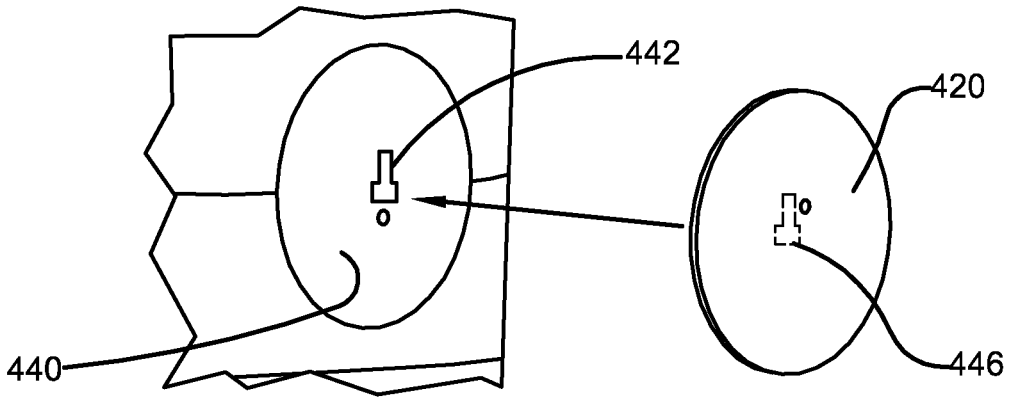
FIGS. 5A-C illustrate a perspective view of the decorative element with a T-peg attachment mechanism in accordance with the disclosed architecture.
Figure 5B:
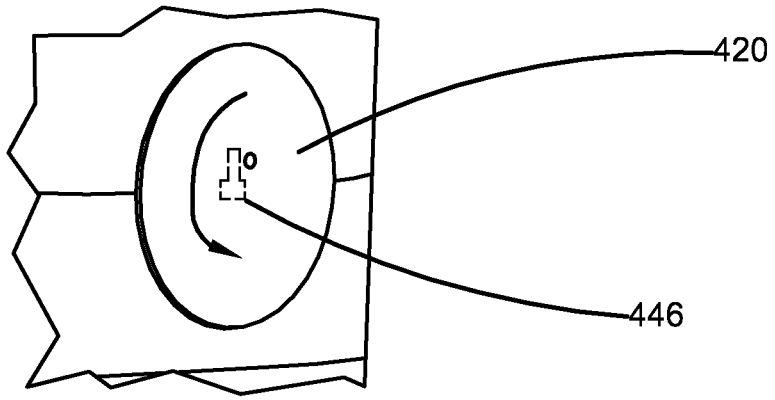
Figure 5C:
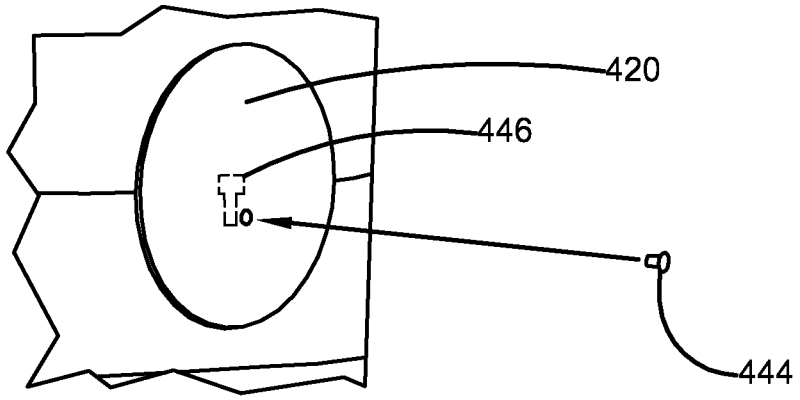

A user may select the decorative element 420 available that is desirable. The decorative element 420 may comprise any design that the user desires, such as a spider shape, a cross, a directional arrow, and a picture for example. As illustrated in FIGS. 5A-C, the decorative element 420 comprises the T-peg 446 on the back of the decorative element 420. The T-peg 446 is orientated upside down on the decorative element 420 as compared to the T-slot 442 in the attachment surface 440. To attach the chosen decorative element 420 to the wakeboard 400, the user inserts the T-peg 446 into the T-slot 442. In this position, the decorative element 420 will be orientated upside down on the wakeboard 400. The decorative element 420 is then rotated substantially 180 degrees so that it is now upright in orientation. However, the T-peg 446 has rotated substantially 180 degrees as well and is now temporarily locked in position in the T-slot 442. To remove the decorative element 420, the process is simply reversed.

What has been described above includes examples of the disclosed device. It is, of course, not possible to describe every conceivable combination of components and/or methodologies, but one of ordinary skill in the art may recognize that many further combinations and permutations are possible. Accordingly, the novel device is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A paddleboard for use in water comprising:

a body portion comprising a top surface and a bottom surface, wherein the top surface comprises a substantially flat portion for receiving a user; and a rudder; and wherein the body portion has sufficient buoyancy for retaining the paddleboard and the user at a surface of a body of water, and wherein the top surface comprises at least one glow in the dark element; and wherein the at least one glow in the dark element is attached to the top surface via a plurality of securing bands which hold the at least one glow in the dark element in place on the top surface of the body portion; and wherein the plurality of securing bands comprise a photoluminescent material and are attached to the top surface.

2. The paddleboard of claim 1, wherein the rudder is moveable.

3. The paddleboard of claim 1, wherein the rudder is fixed.

4. The paddleboard of claim 1, wherein the body portion comprises at least one of the following materials: fiberglass, epoxy, or carbon fiber.

5. The paddleboard of claim 1, further comprising at least one paddle and wherein the at least one paddle comprises at least one glow in the dark element.

6. The paddleboard of claim 1, wherein the at least one glow in the dark element comprises a photoluminescent material, which covers at least 5-100% of surface area of the top surface.

7. The paddleboard of claim 6, wherein the top surface is lined, dyed, painted, or coated with a layer of a photoluminescent material.

8. The paddleboard of claim 7, wherein the at least one glow in the dark element comprises one of the following materials: zinc sulfide, strontium aluminate.

9. The paddleboard of claim 8, wherein the at least one glow in the dark element fluoresces a plurality of colors.

10. A wakeboard comprising:

a body portion comprising a top surface and a bottom surface, wherein the top surface comprises a substantially flat portion for receiving a user;

at least one binding; and at least one fin; and wherein the body portion has sufficient buoyancy for retaining the wakeboard and the user at a surface of a body of water, and wherein the top surface comprises at least one glow in the dark element; and wherein the top surface further comprises an attachment surface and a detachable photoluminescent decorative element; and wherein the detachable photoluminescent decorative element comprises a T-peg for inserting into a T-slot in the attachment surface.

11. The wakeboard of claim 10, wherein the at least one glow in the dark element comprises a photoluminescent material, which covers at least 5-100% of surface area of the top surface.

12. The wakeboard of claim 11, wherein the top surface is lined, dyed, painted, or coated with a layer of a photoluminescent material.

13. The wakeboard of claim 10, wherein the at least one glow in the dark element comprises a phosphor.

14. The wakeboard of claim 10, wherein the at least one glow in the dark element comprises at least one of the following: a patch, a decal, a strap, a panel, a portion of the top surface.

15. The wakeboard of claim 10, wherein the at least one glow in the dark element comprises one of the following materials: zinc sulfide, strontium aluminate.

16. The wakeboard of claim 10, wherein the at least one glow in the dark element fluoresces a plurality of colors.

17. A paddleboard comprising:

a body portion comprising a top surface and a bottom surface, wherein the top surface comprises a substantially flat portion for receiving a user; and a rudder; and wherein the body portion has sufficient buoyancy for retaining the paddleboard and the user at a surface of a body of water, and wherein the top surface comprises a rechargeable phosphorescent compound and a recharging source; and wherein the rechargeable phosphorescent compound is a single layer of material integrated with a phosphor based photoluminescent material.

18. The paddleboard of claim 17, wherein the recharging source comprises an light emitting diode (LED), a visible light source, an ultraviolet source, or a black ultraviolet source.

19. The paddleboard of claim 17, further comprising a chemiluminescent element and a reflective element attached to the top surface.

20. The paddleboard of claim 17, wherein the phosphorescent compound is rechargeable with a radioactive source.

* * * * *